US009140024B2

(12) United States Patent
Gable et al.

(10) Patent No.: US 9,140,024 B2
(45) Date of Patent: Sep. 22, 2015

(54) PILING EXTENDER

(71) Applicant: Composite Structural Systems, LLC, Lehigh Valley, PA (US)

(72) Inventors: Michael E. Gable, Nazareth, PA (US); James D. Ralph, III, Bethlehem, PA (US); Thomas N. Troxell, Pottstown, PA (US); Gary S. Smrtic, Morgantown, KY (US)

(73) Assignee: Composite Structural Systems, LLC, Lehigh Valley, PA (US)

( * ) Notice: Subject to any disclaimer, the term of this patent is extended or adjusted under 35 U.S.C. 154(b) by 0 days.

(21) Appl. No.: 14/175,748

(22) Filed: Feb. 7, 2014

(65) Prior Publication Data

US 2014/0223856 A1 Aug. 14, 2014

Related U.S. Application Data

(60) Provisional application No. 61/763,677, filed on Feb. 12, 2013.

(51) Int. Cl.

| | |
|---|---|
| ***E04C 3/00*** | (2006.01) |
| ***E04G 23/00*** | (2006.01) |
| ***E04F 15/02*** | (2006.01) |

(52) U.S. Cl.

CPC ..... *E04G 23/00* (2013.01); *E04F 15/02* (2013.01)

(58) Field of Classification Search

CPC ..... E04F 15/02; E04G 23/00

USPC ..... 52/223.4, 244, 246, 249, 834, 835, 838, 52/844, 301, 296, 481.1, 849

See application file for complete search history.

(56) References Cited

U.S. PATENT DOCUMENTS

| | | | | | |
|---|---|---|---|---|---|
| 883,569 | A | * | 3/1908 | Rodgers | 249/51 |
| 969,097 | A | * | 8/1910 | Ford | 52/301 |
| 1,039,498 | A | * | 9/1912 | Deslauriers | 249/49 |
| 1,489,742 | A | * | 4/1924 | Davenhall | 52/244 |
| 1,547,175 | A | * | 7/1925 | Lally | 52/301 |
| 2,044,422 | A | * | 6/1936 | Davidson | 40/538 |
| 2,046,152 | A | * | 6/1936 | Dean | 52/301 |
| 2,499,478 | A | * | 3/1950 | Feser | 52/81.3 |
| 2,874,812 | A | * | 2/1959 | Clevett, Jr. | 52/223.7 |
| 3,106,270 | A | * | 10/1963 | Lichty et al. | 52/301 |
| 3,291,437 | A | * | 12/1966 | Bowden et al. | 249/48 |
| 3,505,825 | A | * | 4/1970 | Colby | 405/223 |
| 3,594,973 | A | * | 7/1971 | Archer et al. | 52/711 |
| 3,654,767 | A | * | 4/1972 | Cavin | 405/241 |
| 3,713,259 | A | * | 1/1973 | Tkach | 52/111 |
| 3,751,196 | A | * | 8/1973 | Cannon et al. | 425/4 R |
| 4,023,374 | A | * | 5/1977 | Colbert et al. | 405/216 |
| 4,216,634 | A | * | 8/1980 | Binder | 52/309.9 |

(Continued)

OTHER PUBLICATIONS

FWH Associates, PA, Construction Specification "Hale Built Pressure Grouted Displacement Pile Foundation", Nov. 2013.

(Continued)

*Primary Examiner* — Basil Katcheves

(74) *Attorney, Agent, or Firm* — Lowenstein Sandler LLP

(57) ABSTRACT

A method and system for extending a vertical structural member supporting a structure, where a sleeve is coupled to the vertical structural member such that a portion of the sleeve extending from a first end of the sleeve is about the structural member, a cap is coupled to a second end of the sleeve opposite the first end, and a structure attachment device is coupled to the cap to attach the system to the structure.

7 Claims, 13 Drawing Sheets

(56) References Cited

U.S. PATENT DOCUMENTS

| | | | | |
|---|---|---|---|---|
| 4,439,071 | A * | 3/1984 | Roper, Jr. | 405/216 |
| 4,606,167 | A * | 8/1986 | Thorne | 52/834 |
| 4,754,588 | A * | 7/1988 | Gregory | 52/294 |
| 4,838,737 | A * | 6/1989 | Quimby | 405/230 |
| 4,995,206 | A * | 2/1991 | Colonias et al. | 522/97 |
| 5,150,557 | A * | 9/1992 | Gregory | 52/646 |
| 5,263,297 | A * | 11/1993 | Kim | 52/834 |
| 5,285,614 | A * | 2/1994 | Fouad | 52/848 |
| 5,439,043 | A * | 8/1995 | Carter | 160/135 |
| 5,457,929 | A * | 10/1995 | Kim | 52/834 |
| 5,675,956 | A * | 10/1997 | Nevin | 52/848 |
| 5,765,333 | A * | 6/1998 | Cunningham | 52/481.1 |
| 5,869,159 | A * | 2/1999 | Padilla | 428/40.1 |
| 6,167,673 | B1 * | 1/2001 | Fournier | 52/848 |
| 6,192,646 | B1 * | 2/2001 | Grewe et al. | 52/834 |
| 6,340,790 | B1 * | 1/2002 | Gordin et al. | 174/45 R |
| 6,591,570 | B2 * | 7/2003 | Miller, Jr. | 52/632 |
| 6,705,058 | B1 * | 3/2004 | Foust et al. | 52/296 |
| 6,929,571 | B2 * | 8/2005 | Jesch et al. | 473/479 |
| 6,997,260 | B1 * | 2/2006 | Trader et al. | 166/277 |
| 7,343,713 | B2 * | 3/2008 | Knepp et al. | 52/126.1 |
| 7,556,752 | B1 * | 7/2009 | Hicks | 264/32 |
| 7,607,276 | B2 * | 10/2009 | Gordin et al. | 52/834 |
| 8,397,442 | B2 * | 3/2013 | Laurin | 52/126.6 |
| 2005/0016111 | A1 * | 1/2005 | Knepp et al. | 52/633 |
| 2005/0056760 | A1 * | 3/2005 | Carlson | 248/354.3 |

OTHER PUBLICATIONS

Pilecap, Inc. "Repair and Replacement Systems", retrieved from www.pilecapinc.com/products/repair-and-replacement-systems on Feb. 21, 2014.

* cited by examiner

PILING EXTENDER

RELATED APPLICATIONS

This application claims priority to U.S. Provisional Application No. 61/763,677, entitled PILING EXTENDER, and filed Feb. 12, 2013, the entire contents of which are hereby incorporated by reference herein.

TECHNICAL FIELD

Embodiments of the invention relate generally to systems and methods for extending and reinforcing vertical structural members.

BACKGROUND

Vertical structural members, often called pilings, can be as any column, pile, bollard, post, buttress, strut, pillar, pole or similar structure that serves as a structural support to elevate a structure, such as a building, dock, bridge, etc. For example, vertical members may be, but are not limited to be, pilings under homes, structures, bridges, docks, piers, bulk heads, water or land based platforms, utility poles, or other similar structures. Over time, vertical structural members can be damaged due to wear and tear from natural and/or man-made forces, such as wave action, acid rain, ultraviolet radiation, vibrations from traffic, corrosion, pest/insect damage, etc. Further, vertical structural members can sustain serious damage due to events that result in strong forces being exerted on the vertical structural member, such as a hurricane, an earthquake, a tornado, or an impact from a vehicle, a boat, or an airplane. Vertical structural members that are already installed may be determined to have insufficient length to provide support at a safe height for the structure being supported. For example, due to rising water levels, a length of vertical structural support as designed and built may no longer be sufficient for a structure.

Current solutions for extending the height of vertical structural members and/or for the repair of damaged portions of vertical structural members may not provide sufficient structural stability or may be prohibitively expensive or difficult to execute. Splicing of pilings to extend or repair a piling, where an existing piling and a new piling are notched with matching notches and then fastened together, is generally not an acceptable practice under most building codes, because the splice does not adequately transmit moment loading from the new section of piling to the existing section. Additionally, the connection exposes more surface area of the piling to the atmosphere, which can increase the risk of dry rot and insect damage.

Further, placing of concrete, whether poured or block type construction, on top of the piling to extend the height of the piling or replace a damaged section of piling generally does not provide adequate moment loading as the tensile force on the concrete could exceed that available to the concrete. If steel reinforcement is added to the concrete, the additional concrete required to fully encapsulate the steel reinforcement would create significant additional loading on the piling, reducing the available loading capacity of the piling. Further, joints resulting from block construction can be exposed to weathering, which can create a long term maintenance concern.

Additionally, using helical piling drilling to extend or repair pilings can be costly. Also, while structures can be raised and moved away from the current location such that new pilings can be installed, this option is not available on sites with limited space to store the structure and can be expensive.

SUMMARY OF THE INVENTION

An embodiment of the present invention is directed to a system for extending a vertical structural member supporting a structure. The system includes a sleeve to couple to the vertical structural member such that a portion of the sleeve extending from a first end of the sleeve is about the structural member, a cap coupled to a second end of the sleeve opposite the first end, and a structure attachment device coupled to the cap, the structure attachment device to attach the system to the structure.

The system can include a fill material, wherein the sleeve is about the fill material. The fill material can be a flowable fill material.

The system can include a cap spacer, wherein the sleeve is coupled to the cap via the cap spacer. The system can include a sleeve spacer, wherein the sleeve is coupled to the sleeve spacer to accommodate variation in a perimeter of the vertical structural member.

The structure attachment device can include a U-bolt. A horizontal portion of the U-bolt can be between the cap and the vertical structural member, and a first vertical portion and a second vertical portion of the U-bolt can extend through openings in the cap to couple to a joist of the structure via a bracket.

The sleeve can be coupled to the vertical structural member via a chemical bonding agent and/or via a mechanical fastener.

The sleeve can include a first sleeve and a second sleeve, the first sleeve to couple to a first portion of a perimeter of the vertical structural member and the second sleeve to couple to a second portion of the perimeter opposite the first portion of the perimeter.

An embodiment of the present invention is directed to a method of extending a vertical structural member supporting a structure. The method can include coupling a sleeve to the vertical structural member, wherein a portion of the sleeve extending from a first end of the sleeve is about the vertical structural member, coupling a cap to a second end of the sleeve opposite the first end, and coupling a structure attachment device to the cap, wherein the structure attachment device is to attach to the structure.

BRIEF DESCRIPTION OF THE DRAWINGS

The present invention is illustrated by way of example, and not by way of limitation, and will become apparent upon consideration of the following detailed description, taken in conjunction with the accompanying drawings, in which like reference characters refer to like parts throughout, and in which.

DETAILED DESCRIPTION

In the following description, numerous details are set forth. It will be apparent, however, to one skilled in the art, that the present invention may be practiced without these specific details. In some instances, well-known structures and devices are shown in block diagram form, rather than in detail, in order to avoid obscuring the present invention.

In implementations, a method and system are provided for extending and/or repairing vertical structural members, such as pilings. A modular system including a sleeve, a cap, and a structure attachment device, according to embodiments, provides flexibility to accommodate irregular shapes and dimensions of vertical structural members, which can be inherent to wooden pilings. In an embodiment, sleeve spacers can be used to vary the size of the sleeve, and glues and/or resins can be used to fill voids and/or irregularities in the vertical structural member, such that the system is easily adaptable and installable by a user, such as an installation contractor. The use of the sleeve spacer and glue/resin system can further provide the ability to correct vertical alignment issues which can also be problematic with a driven pile. In an example, alignment can be corrected by up to about 6 degrees.

There are many circumstances, whether from legal mandate or simply structural protection, which require structures to be raised to a height above their existing height. The system described herein allows a structure (e.g., a house, dock or other large building) to be raised without the need to replace the existing pilings. The piling extenders can be provided in a variety of diameters to accommodate different size pilings (e.g., from about 4 inches to about 50 inches) and different lengths (e.g., from about 12 inches to about 25 feet) to accommodate different heights the structure needs to be raised. The system can be also be used as to replace or encapsulate damaged portions of the member or so provide additional structural support to a vertical structure member.

Figure 1:
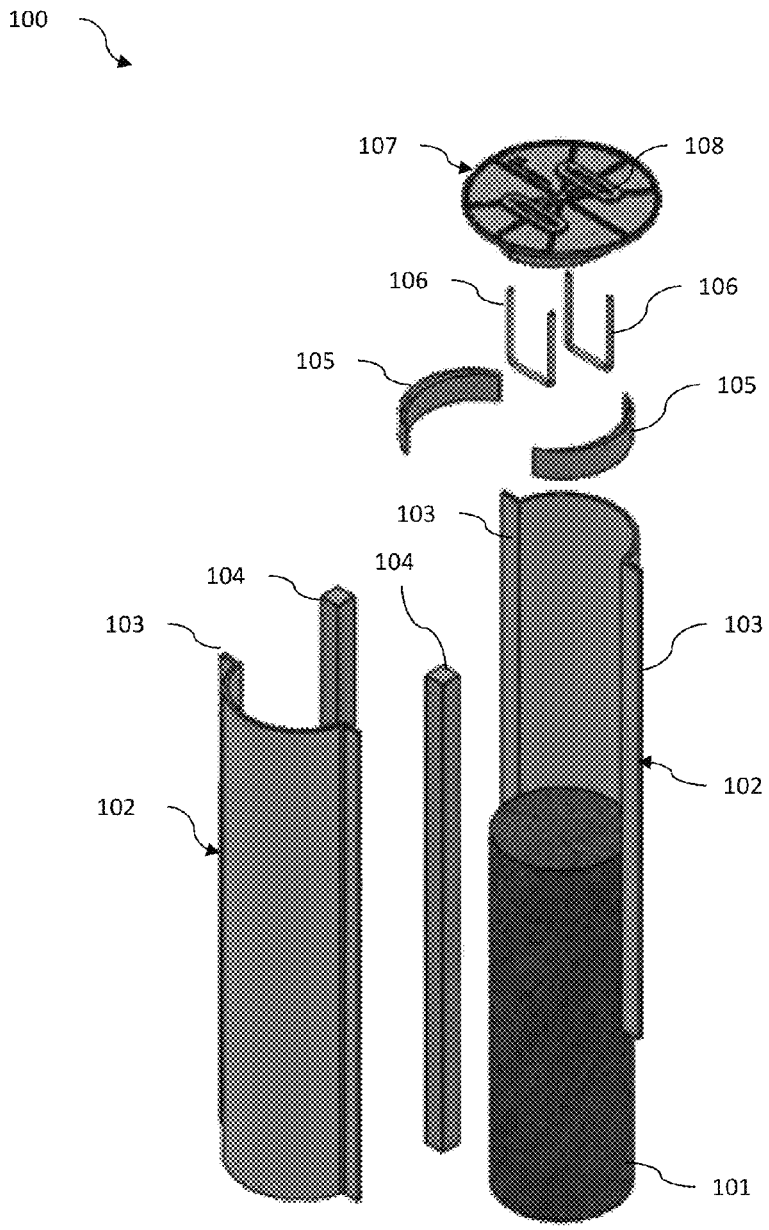
FIG. 1 is an illustrative exploded view of a system for extending a vertical structural member in accordance with an embodiment of the present invention.
Figure 2:
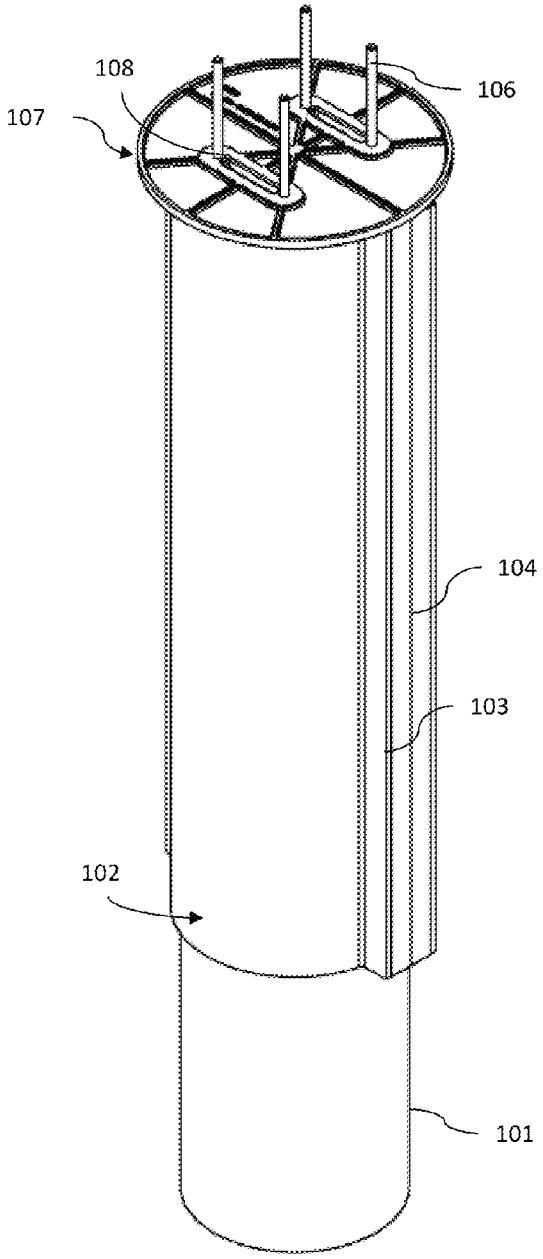
FIG. 2 is an illustrative assembled view of the system of FIG. 1.

FIGS. 1 and 2 are an exploded view and an assembled view, respectively, of a system for extending (and/or repairing) a vertical structural member 101 in accordance with an embodiment of the present invention. One or more sleeves 102 can be positioned about the vertical structural member 101. For example, as shown in FIG. 1, two sleeves 102 can be positioned about the vertical structural member 101 such that each sleeve 102 is about a portion of the perimeter of the vertical structural member 101. The two sleeves 102 can be positioned such that a first end (or first portion) of the sleeves overlaps a portion (e.g., a top portion) of the vertical structural member 101 and a second end (or portion) of the sleeves does not overlap the vertical structural member 101. The sleeves 102 can wrap around the vertical member 101 and extended to the desired height above the vertical structural member 102.

In an embodiment, the sleeves 102 can be wrapped around the vertical structural member 102 to create a longer vertical structural member to thus raise a structure supported by the vertical structural member to a higher position. In an embodiment, the sleeves 102 can be wrapped around the vertical structural member 101 to reinforce the vertical structural member. Alternately, a damaged portion of the vertical structural member can be removed and the sleeves can be placed on the remaining portion of the vertical structural member at the top and bottom with a new member matching the dimensions of the existing vertical structural member inserted in the void area left by the removal of the damaged vertical structural member.

The sleeves 102 can be constructed of fiberglass, ferrous materials of any suitable type, nylon, structural plastics, composites, or any other suitable inorganic material, depending on the environment of intended use.

The sleeves 102 can be connected or coupled to the vertical structure member 101 by chemical bonding agents and/or mechanical fasteners. For example, the sleeves 102 can be coupled to the vertical structural member 101 by resins or glues, where the resin or glue is applied to an inner surface of the sleeve 102 (e.g., by any suitable application method, such as injection, painting, spraying, etc.) between the sleeve 102 and the vertical structural member 101. Examples of glues and resins include high strength acrylic, epoxy, or urethane bonding systems. In another example, the sleeves 102 can be coupled to the vertical structural member 101 by mechanical fasteners (e.g., screws, bolts, nails, pegs, clamps, etc.) where the mechanical fasteners can extend (e.g., radially) through the sleeve 102 and into the vertical structural member 101 and/or the mechanical fasteners can fix the sleeve to itself or another sleeve 102 such that the sleeve(s) 102 are coupled to the vertical structural member 101 via a friction fit. In an embodiment, the sleeves have holes to allow for fastening to the vertical structural member to prevent sliding and provide additional strength.

In an embodiment, the sleeves are fabricated to the desired dimensions. In another embodiment, the sleeves are cut to the desired dimensions after fabrication, either prior to attaching to the vertical structure member or after the sleeve is attached.

In an embodiment, the sleeve 102 has a flange 103 along a vertical length of one or both sides of the sleeve 102. In the embodiment shown in FIGS. 1 and 2, two sleeve 102 can be fastened together by their flanges 103 via a chemical bonding agent (e.g., glue and/or resin) and/or a mechanical fastener (e.g., screws, bolts, nails, pegs, clamps, etc.). In another embodiment where one sleeve is used, the sleeve can be fastened to itself with the flanges 103 on either side of the sleeve via a chemical bonding agent (e.g., glue and/or resin) and/or a mechanical fastener (e.g., screws, bolts, nails, pegs, clamps, etc.).

In an embodiment, sleeve spacers 104 can be utilized with sleeves 102 e.g., between flanges 103 when provided, to allow for variation in vertical structural member dimension and/or to accommodate larger vertical structure members. In the example shown in FIG. 3, vertical structure member 101A can be a twelve inch piling, and two sleeve spacers 104 are utilized with two sleeves 102, where one sleeve spacer 104 is positioned between the flanges 103 at one side of the respective sleeves 102 and another sleeve spacer 104 is positioned between the flanges 103 at the opposite side of the respective sleeves 102.

Figure 4:
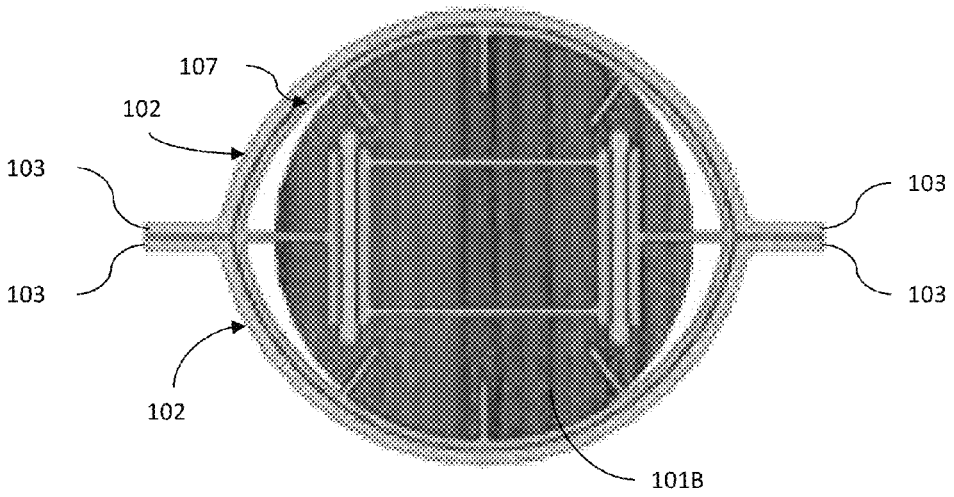
FIG. 4 is an illustrative assembled view of the system of FIG. 1 without a spacer in accordance with an embodiment of the present invention.

In FIG. 4, a vertical structure member 101B is a piling with a ten inch diameter. Here, sleeve spacers 104 are not utilized because vertical structure member 101B is small enough that two sleeves 102 can be wrapped all the way around the vertical structure member 101B. In this example, the flanges 103 of the respective sleeves 102 can be coupled directly together using a high strength adhesive such as an acrylic or epoxy system.

Figure 3:
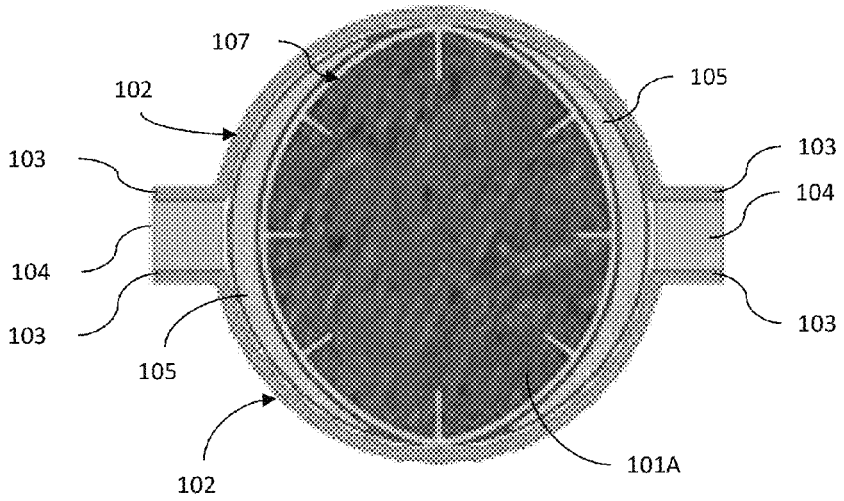
FIG. 3 is an illustrative cross-sectional view of the system of FIG. 1.

In other words, though the sleeves 102 utilized with the twelve inch vertical structure member 101A of FIG. 3 may have the same dimensions as the sleeves 102 utilized with the ten inch vertical structure member 101B of FIG. 4, the spacers 104 allow the larger twelve inch vertical structure member 101A to fit within the sleeves 102. Because the sleeves 102 can accommodate vertical structure members of different diameters, installation can be made easier and production costs of the system can be reduced. In other examples, only one sleeve spacer is utilized or more than two sleeve spacers are utilized.

The material of the sleeve spacers 104 may be any suitable material, which may or may not match the sleeve material, depending on the environment of intended use, such as fiberglass, ferrous materials of any suitable type, nylon, structural plastics, composites, or any other suitable inorganic material. The spacers 104 can be attached to the flanges 103 via a mechanical fastener (e.g., screws, bolts, nails, pegs, clamps, etc.) and/or a chemical bonding agent (e.g., glue and/or resin).

In an embodiment, a space defined by the sleeves 102 can be filled (e.g., with fill material) or not, depending on the loading conditions (e.g., of the structure to be supported by the vertical structural member). The fill material can be concrete, whether reinforced or not, a flowable fill material (e.g., structural foam or resin, such as a filled epoxy or urethane system), a section of piling or any other suitable material. In an example, the fill material can be a Portland Cement per ASTM C150 of any type providing a minimum compressive strength of 1000 psi, along with any suitable aggregate and/or reinforcement.

Rather than notching a vertical structural member to connect a structure to the vertical structural member, which can reduce the available strength of the vertical structural member by as much as half and expose more surface area to the environment to increase the risk of damage from dry rot and insect damage, embodiments of the system can utilize a cap to facilitate connection to a structure to maintain the structural integrity of the vertical structural member.

Returning to FIGS. 1 and 2, a cap 107 can be attached to an end of the sleeve(s) 102 opposite the vertical structural member 101, according to an embodiment. For example, the cap 107 can be attached via a mechanical fastener (e.g., screws, bolts, nails, pegs, clamps, etc.) and/or a chemical bonding agent (e.g., glue or resin). The cap 107 may include a portion that extends into a space defined by the sleeve(s) 102. The material of the cap 107 may be of any suitable material, such as fiberglass, ferrous materials of any type, nylon, structural plastics, composites, or other inorganic material, dependent on the environment of its intended use and loading conditions.

In an embodiment, the cap 107 can protect the vertical structure member 101 and/or the fill material from weathering, corrosion, pests, and other environmental assaults. In an embodiment, a glue or resin fills any space between the fill material and/or the vertical structure member 101 and the cap 107. The glue or resin may be inserted into this space prior to installation of the cap 107, or the glue or resin may be inserted or injected into this space after installation of the cap 107 (e.g., though an injection port).

As shown in FIGS. 1 and 3, one or more cap spacers 105 can be utilized between sleeve(s) 102 and the cap 107, to allow for variation in vertical structural member 101 dimension, according to an embodiment. The material of the cap spacers 105 can be of any suitable material, which may or may not match the sleeve 102 material, depending on the environment of intended use, such as fiberglass, ferrous materials of any type, nylon, structural plastics, composites, or other inorganic material. The cap spacers 105 can be attached to the sleeves 102 and the caps 107 via a mechanical fastener (e.g., screws, bolts, nails, pegs, clamps, etc.) and/or a chemical bonding agent (e.g., glue or resin). As shown in FIG. 3, cap spacers 105 can allow the system to be utilized with vertical structure members of different sizes. Here, the twelve inch vertical structure member 101A is accommodated by utilizing the cap spacers 105 to fill space between the cap 107 and the sleeves 102. In an embodiment, resin or glue can be inserted in spaces between the cap spacers 105, the cap 107, and the sleeve(s) 102.

According to an embodiment, one or more structure attachment devices 106 can be utilized to couple the system to the structure. The structure attachment device 106 can be coupled to the cap 107 via a mechanical fastener (e.g., screws, bolts, nails, pegs, clamps, etc.) and/or a chemical bonding agent. Furthermore, the structure attachment device 106 can be coupled to the structure via a mechanical fastener and/or a chemical bonding agent. The structure attachment device 106 can be a single molded piece or can be constructed of individual structural pieces. For example, the structure attachment devices 106 shown in FIG. 1 are square U-bolts with threaded ends.

Figure 5:
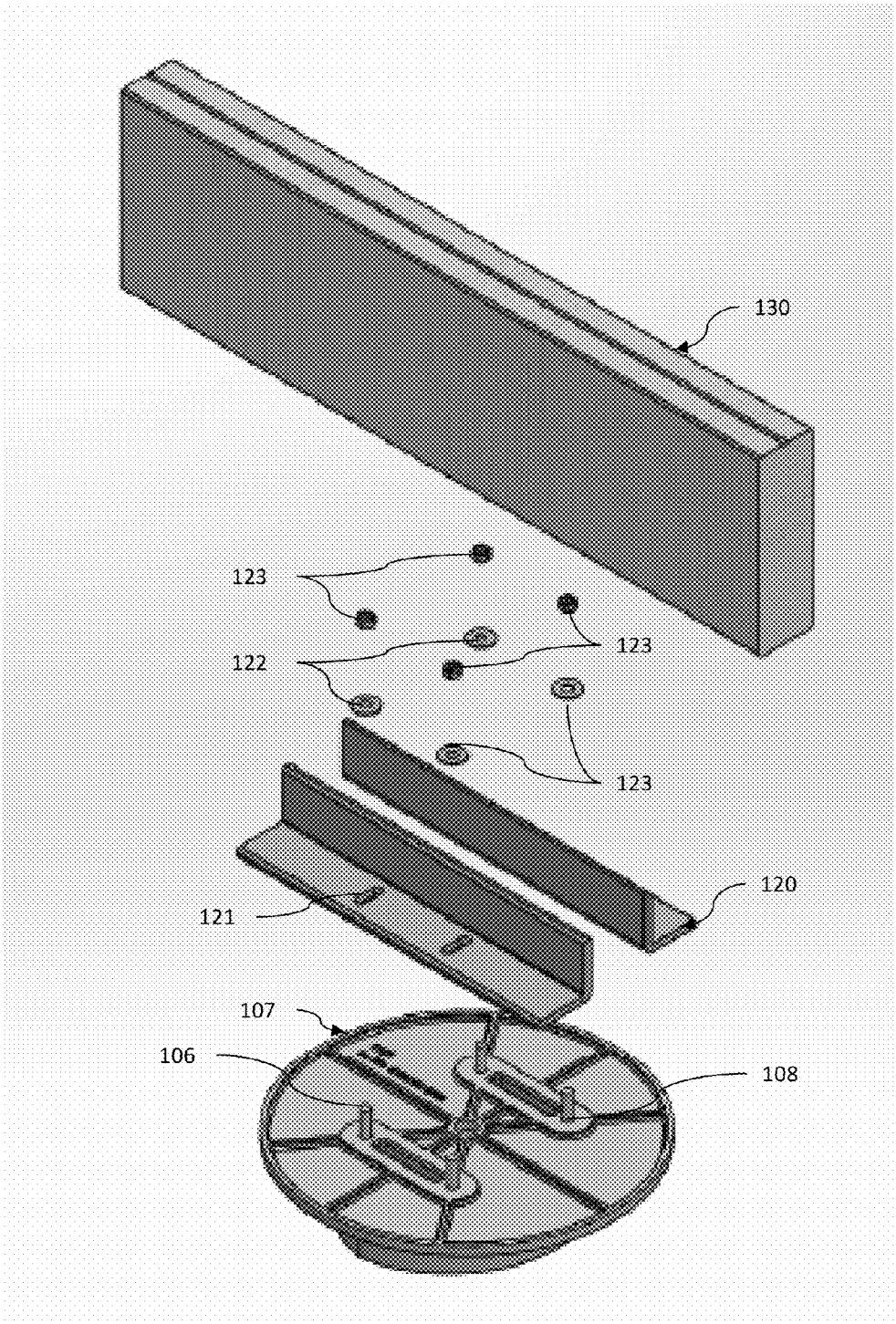
FIG. 5 is an illustrative exploded view of attachment of the system of FIG. 1 to a structure.
Figure 6:
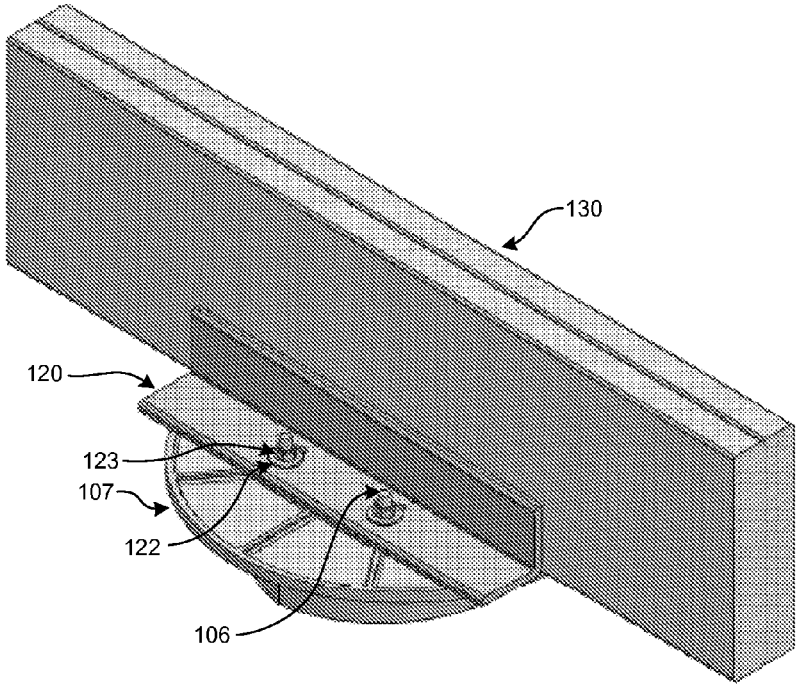
FIG. 6 is an illustrative assembled view of attachment of the system of FIG. 1 to a structure.
Figure 7:
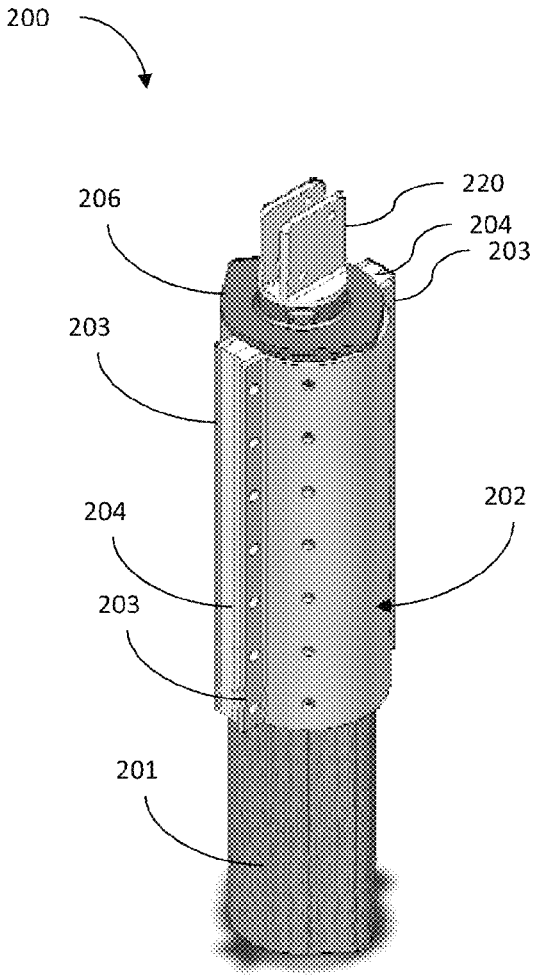
FIG. 7 is an illustrative assembled view of a system for extending a vertical structural member in accordance with another embodiment of the present invention.
Figure 8:
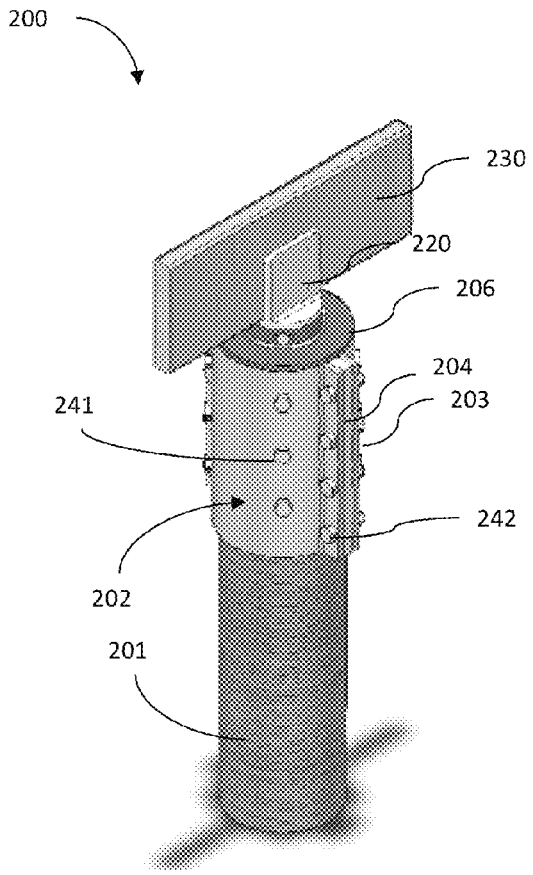
FIG. 8 is an illustrative assembled view of attachment of the system of FIG. 7 to a structure.
Figure 9:
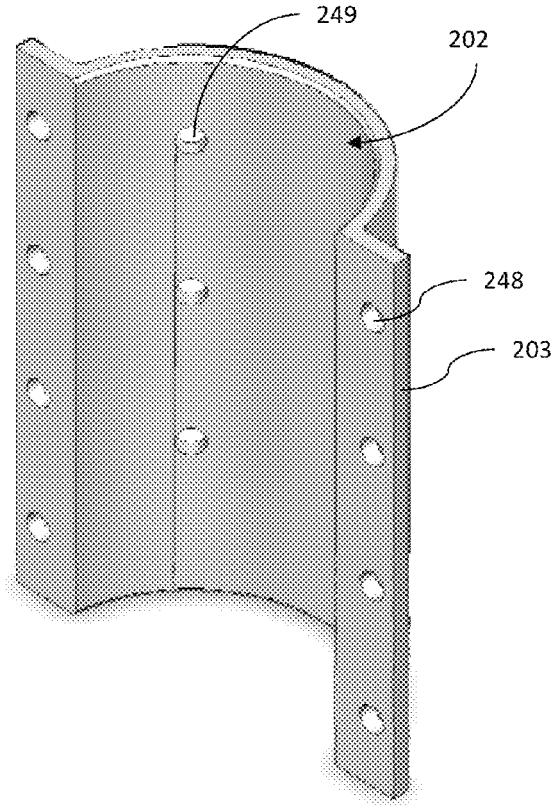
FIG. 9 is an illustrative view of a sleeve in accordance with an embodiment of the present invention.
Figure 10:
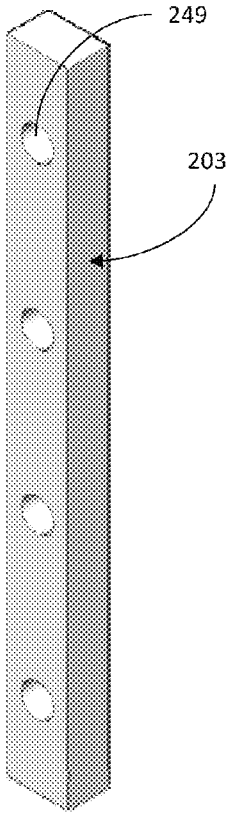
FIG. 10 is an illustrative view of a sleeve spacer in accordance with an embodiment of the present invention.
Figure 11:
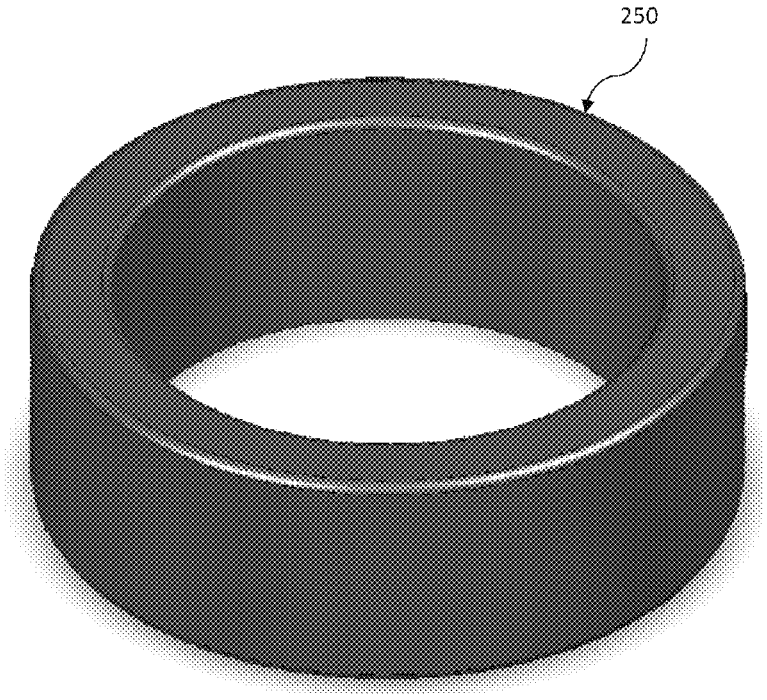
FIG. 11 is an illustrative view of a cap spacer in accordance with an embodiment of the present invention.
Figure 12:
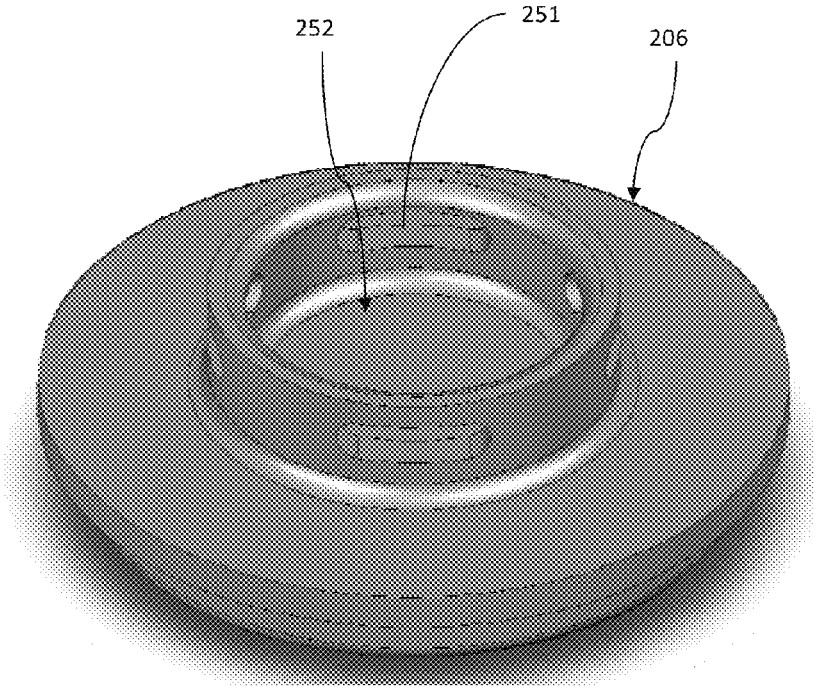
FIG. 12 is an illustrative view of a cap in accordance with an embodiment of the present invention.
Figure 13:
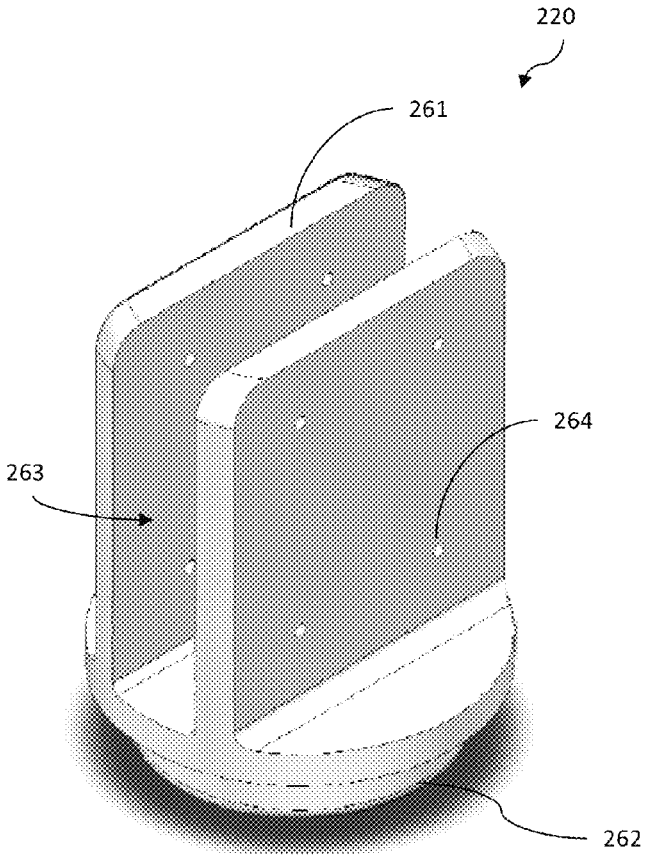
FIG. 13 is an illustrative view of a structure attachment device in accordance with an embodiment of the present invention.

In FIGS. 5 and 6, two structure attachment devices 106 (i.e., U-bolts) are shown, where each of the threaded ends of each structure attachment devices 106 extends through openings 108 in the cap 107. Each of the threaded ends can then be positioned though openings 121 in one or more brackets 120 (e.g., the ends of one U-bolt extending though holes in one L-bracket and the ends of the other U-bolt extending through another L-bracket) and secured with suitable washers 122 and nuts 123. The brackets 120 can then be coupled to the structure 130 (e.g., a joist or beam of the structure). For example, the brackets 120 can be coupled to the structure 130 via a friction fit, a mechanical fastener, and/or a chemical bonding agent.

In an embodiment, resin fills and/or glue can be utilized to bond elements of the system (e.g., sleeves, sleeve spacers, caps, cap spacer, and/or structure attachment devices) together and the system to a vertical structure member, seal wooden members (e.g., a vertical structure member) to protect from dry rot, and to fill voids between the vertical structural member and elements of the system (e.g., the sleeves, the sleeve spacers, the cap, and/or the cap spacer). In an embodiment, the resin fills and/or glue can have a minimum lap sheer of about 430 MPa.

According to embodiments, performance standards can vary from one application to another. In an example for raising structures on circular wooden pilings, e.g., 12" diameter Southern White Pipe wooden pilings, the system could have a bending moment of 65 ft-Kips, shear (e.g., lateral forces) of 10 Kips, vertical loading (vertical compression) 90 Kips, and alignment/plumb correction of 6 degrees. However, performance can be limited by the available reaction force of the structure to which the system is connected.

FIGS. 7-13 illustrate another embodiment of the system 200 for extending and/or repairing a vertical structural member 201, which can include one or more sleeves 202 with flanges 203 coupled to the vertical structural member 201, one or more sleeve spacers 204 positioned between the flanges 203, a cap 206 coupled to the sleeve 102, and a structure attachment device 220 coupled to the cap 206. The sleeve 202 (shown in FIG. 9), flanges 203 (shown in FIG. 9), and sleeve spacers 204 (shown in FIG. 10) can be similar to the corresponding components described above.

In an embodiment, sleeve 202 can have openings 249 for passage of a mechanical fastener (e.g., a screw, nail or bolt) through the sleeve 202 and into the vertical structural member 201 to allow for the sleeve 202 to be mechanically fastened to the vertical structural member 201. Sleeve 202 can also have openings 248 along a flange 203 for passage of a mechanical fastener (e.g., a screw, nail or bolt) through the flange 202 to allow for the flange 203 to be mechanically fastened to the flange 203 on the other side of a single sleeve 202, to the flange 203 of another sleeve, or to sleeve spacer 204 positioned between flanges 203.

In an embodiment, a cap spacer 250 (shown in FIG. 11) can have a donut shape. The height of the cap spacer 250 can be determined such that the cap spacer 250 will rest on top of the vertical structure member, and a cap 206 (show in FIG. 12) will rest on top of the cap spacer 250 and the tops of the sleeves 202. In an embodiment, the cap spacer 250 can be secured, e.g., by driving lag screws through holes in the sleeves 202 into the cap spacer 250 or by the application of glues or resins. Optionally, a plate may be placed between the cap spacer 250 and the vertical structure member 201 (and may also be fastened with glue or fasteners) to provide load bearing from the top of the sleeve 202. In certain embodiments, the plate may also include a support to, e.g., support a load.

In an embodiment, the structure attachment device 220 (shown in FIG. 13) is aligned such that a bottom portion 262 extends into a receptacle 252 of the cap 206 and can be attached to the cap 206 via one or more bolts extending through opening 251 in the cap 206. However, prior to attachment of the structure attachment device 220 to the cap 206, the structure attachment device 220 can be rotated such that a space 263 is aligned to receive a portion of the structure 230 (e.g., the floor joist) between vertical clamp portions 261. Once the structure is positioned between the vertical clamp portions 261, the structure 230 can be attached to the structure attachment device 220, e.g., via screws or bolts extending through openings 264 in the vertical clamp portions 261 and into the structure.

Figure 14:
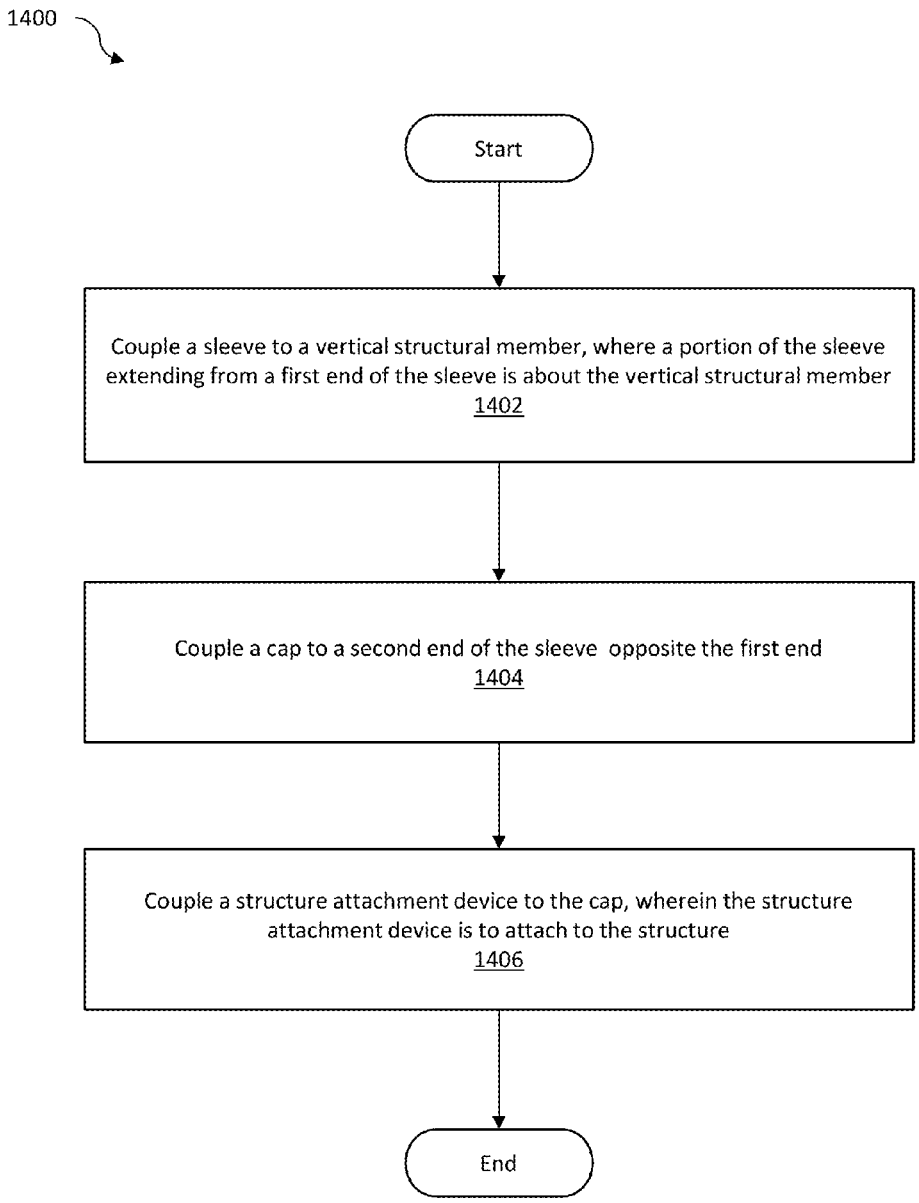
FIG. 14 illustrates a method of extending a vertical structural member in accordance with an embodiment.

FIG. 14 illustrates a method 1400 of extending a vertical structural member supporting a structure in accordance with an embodiment. In an embodiment, the method can be performed utilizing system 100 (shown in FIGS. 1 and 2) or system 200 (shown in FIGS. 6 and 7).

In an embodiment, the vertical structural member is initially prepared to be extended and/or repaired. For example, the vertical structural member can be cleaned (e.g., of debris) and cut to a suitable height (e.g., a height corresponding to other vertical structural members being used to support the structure). Further, damaged portions of the vertical structural member can be removed. The vertical structural member can also be planed along a length of the vertical structural member to correct alignment. For example, a portion of a side of a leaning vertical structural member can removed such that when the vertical structural member is repaired and/or extended with a the system, the system can be adjusted to be plumb or vertical (e.g., up to about 6 degrees of correction).

At block 1402, a sleeve is coupled to a vertical structural member, where a portion of the sleeve extending from a first end of the sleeve is about the vertical structural member. For example, the sleeve can be coupled to the vertical structural member via a mechanical fastener or a chemical bonding agent. In an embodiment, a sleeve spacer may be utilized to accommodate a circumference of the vertical structural member, where the sleeve spacer is positioned along a length of the sleeve. In an embodiment, two or more sleeves are positioned about the vertical structural member such that each sleeve is about a portion of the vertical structural member to extend all the way around the vertical structural member.

In an embodiment, a resin or glue is applied, inserted, or injected into spaces (e.g., voids) between the vertical structural member and the sleeve to protect the vertical structural member and provide additional coupling strength. In an embodiment, a fill material is inserted into a space within the sleeve above the vertical structural member. For example, the fill material can be concrete, glue, resin, or any other suitable fill material (e.g., a flowable fill material).

At block 1404, a cap is coupled to a second end of the sleeve opposite the first end. For example, the cap can be coupled to the sleeve via a mechanical fastener or a chemical bonding agent. In an embodiment, a cap spacer is coupled between the cap and the sleeve to accommodate a larger vertical structural member and/or fill a gap between the cap and the sleeve.

In an embodiment, a glue or resin is inserted into spaces between the sleeve, the cap, the vertical structural member, the fill material, and/or the cap spacer, e.g., to provide additional coupling strength and/or protect the system and the vertical structural member.

At block 1406, a structure attachment device is coupled to the cap, where the structure attachment device can be attached to the structure. For example, the structure attachment device can be coupled to the cap via a mechanical fastener or a chemical bonding agent. Further, the structure attachment device can be coupled to the structure via a mechanical fastener or a chemical bonding agent.

In an example, the vertical structural member can be a U-bolt (e.g., a square U-bolt), where a horizontal portion of the U-bolt is positioned between the cap and the vertical structural member, and vertical portions (e.g., which can have a threaded section) of the U-bolt extend away from the vertical structural member through openings in the cap. The vertical threaded end portions of the U-bolt can extend though openings in an L-bracket to be fastened to the L-bracket (e.g., via a nut). The L-bracket can be coupled to the structure (e.g., a joist of the structure), e.g., via a mechanical fastener, such as a bolt or a screw, glue or resin, or a friction fit. In an embodiment, two U-bolts, each with a corresponding L-bracket, are utilized to attach the system to the structure.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of claims, which in themselves recite only those features regarded as the invention.

We claim:

1. A system for extending a vertical structural member supporting a structure, the system comprising:

a sleeve having at least two parts, the sleeve adapted to be affixed to an outer periphery of the vertical structural member such that the sleeve encloses a top portion of the vertical structural member and extends past the top portion in a direction along a length of the vertical structure member, wherein the portion of the sleeve extending past the top portion of the vertical structure member defines a fillable interior space above the top portion of the vertical structure member, and wherein the at least two parts of the sleeve are further adapted to receive a sleeve spacer to accommodate variation in a perimeter of the vertical structure member;

a cap coupled to an open end of the sleeve, the cap enclosing the fillable interior space above the top portion of the vertical structure member, and the cap comprising apertures receiving a structure attachment device, wherein a portion of the structure attachment device is housed at least partially within the fillable interior space, wherein the structure attachment device comprises a plurality of vertical members that each pass through the apertures in the cap, and wherein each of the plurality of vertical members extend in the direction along the length of the vertical structure member; and a bracket coupled to the plurality of vertical members of the structure attachment device, the bracket adapted to receive the structure.

2. The system of claim 1 further comprising a fill material, wherein the fill material is disposed within the fillable interior space.

3. The system of claim 2, wherein the fill material is a flowable fill material.

4. The system of claim 1, further comprising a cap spacer, wherein the cap is coupled to the open end of the sleeve via the cap spacer.

5. The system of claim 4, wherein the structure attachment device comprises a U-bolt.

6. The system of claim 1, wherein the sleeve is affixed to the vertical structural member via a chemical bonding agent.

7. The system of claim 1, wherein the sleeve is affixed to the vertical structural member via a mechanical fastener.

* * * * *